US005894216A

United States Patent [19]

Cohen

[11] Patent Number: 5,894,216

[45] Date of Patent: Apr. 13, 1999

[54] SOLID-STATE SATURABLE REACTOR EMULATOR

[75] Inventor: Isaac Cohen, Dix Hills, N.Y.

[73] Assignee: Lambda Electronics Incorporated, Melville, N.Y.

[21] Appl. No.: 09/040,050

[22] Filed: Mar. 17, 1998

[51] Int. Cl.[6] ..... G05F 1/40

[52] U.S. Cl. ..... 323/284; 323/282

[58] Field of Search ..... 323/282, 283, 323/284, 351, 274

[56] References Cited

U.S. PATENT DOCUMENTS 4,719,552 1/1988 Albach et al. ..... 363/44

5,793,191 8/1998 Elmore et al. ..... 323/272

5,804,950 9/1998 Hwang et al. ..... 323/222

*Primary Examiner*—Adolf Deneke Berhane

*Attorney, Agent, or Firm*—David Barron; Jules Jay Morris; Terrence Martin

[57] ABSTRACT

A power converter circuit emulates the functioning of the satuarable reactor therein using a solid state switch in connection with a control circuit. The power converter circuit includes a voltage source and an output. A switch having a control input and current carrying terminals couples the voltage source to the output. An integrator is connected across the current carrying terminals of the switch. A current source is coupled to the integrator. A comparator couples an output of the integrator to the control input of the switch. The comparator turns on the switch when said output of said integrator exceeds a threshold voltage.

21 Claims, 6 Drawing Sheets

SOLID-STATE SATURABLE REACTOR EMULATOR

TECHNICAL FIELD

The present invention relates to regulation and control of voltages. More specifically, the present invention relates to methods and systems for emulating a saturable reactor using solid-state circuitry.

BACKGROUND OF THE INVENTION

The control and regulation of AC and DC voltages has historically been performed by a variety of techniques. One prior technique particularly well suited to switch an AC or pulsed signal used the saturable reactor. More particularly, saturable reactors have been used to regulate AC and pulsed unipolar input signals.

Although saturable reactors were widely used for many years, the development of high-power semiconductor switches (e.g., the thyristor) reduced the use of saturable reactors. Thereafter, the development of high frequency switching converters in the 1970's lead to a resurrection in the usage of saturable reactors. Particularly, the 1970's development of square cores made of low-loss amorphous alloys contributed to the utility of saturable reactors in high-frequency switching power converters.

Even more recently, improvements have been made in the performance of high-speed solid-state switching devices such as, for example, MOSFETs and IGBTs. Thus, once again, solid-state switches have become an attractive alternative to saturable reactors in high-frequency power converters.

Unfortunately, the use of high-speed solid-state switches in modern power converters requires complex and costly control circuits. These circuits are typically implemented in the form of integrated circuits specifically designed for controlling power converters and are generally known as "synchronous switch controllers" or "secondary-side post-regulator controllers". Pulse with modulation is used in these circuits to control the duty cycle of the solid-state switch. In some examples, these circuits generate the pulse width modulated signal by using a SAW tooth oscillator synchronized to an AC waveform in combination with a comparator and assorted logic.

In view of the above, the simplicity of control associated with the saturable reactor makes it a desirable alternative to high speed switching devices in combination with expensive and complex control circuitry. The traditional, magnetic saturable reactor can be expensive and complex to produce, expensive in terms of real estate within a circuit, and has several non-ideal performance parameters resulting from magnetic core and winding interaction and other transformer-type losses and anomalies.

The present invention is directed towards a solution to the above-identified problems.

SUMMARY OF THE INVENTION

The present invention includes circuits in which a saturable reactor is emulated using solid-state circuitry. A semiconductor switch and a low cost control circuit are combined to emulate a virtually ideal saturable reactor. Advantageously, since the solid-state emulator does not exhibit the parasitics associated with a real inductor (such as saturated inductance >0, core loss, non-abrupt saturation, imperfect squareness, etc.), it can be operated at very high frequencies with low losses. Further, the solid-state emulator circuit is self-timed and self-synchronized as is an actual saturable reactor (when included in a power converter circuit). Also, the solid-state emulator circuit is controlled by a DC current which is the analog of the control current for an actual saturable reactor.

Briefly summarized, in a first aspect, the present invention comprises a power converter circuit including an input, an output, a switch, an integrator and a comparator. The switch has a control input and current carrying terminals which couple the input of the circuit to the output. Connected across the current carrying terminals of the switch is the integrator, which includes an integrator output. The comparator couples the integrator output to the control input of the switch such that the comparator turns on the switch when the output of the integrator exceeds a threshold voltage. As an enhancement, the circuit may include a control current source coupled to the integrator.

In one embodiment, the integrator may include a series connected diode, resistor and capacitor. The integrator output may then be a node joining the resistor and capacitor. Also, the control current source may then be connected to the integrator at a node therein joining the diode and resistor.

In another embodiment, the integrator may include a series connected resistor and capacitor. In this instance, the integrator output may be a node joining the resistor and the capacitor. Also, the control current source may then be connected across the capacitor.

As further enhancements, the switch may include unidirectional or bidirectional switching elements. If the switching element is bidirectional, the switch may include a diode in series therewith to impart unidirectionality on the coupling of the circuit input to output. As a further enhancement, the circuit may include a voltage source connected to the input. Further, the control current source may include a dependency on an input to the voltage source such that the circuit is stabilized with respect to variations in voltage level.

In those enhancements where a voltage source is connected to the input of circuit, the voltage source may include, for example, an inverter circuit or a chopper circuit. Also, a load may be connected to the output of the circuit.

As yet another enhancement, the current source coupled to the integrator may controllably affect an amount of energy stored within the integrator. That is, the current source may either inject or extract energy from the integrator.

BRIEF DESCRIPTION OF DRAWINGS

The subject matter regarded as the present invention is particularly pointed out and distinctly claimed in the concluding portion of the specification. The invention, however, both as to organization and method of practice, together with further objects and advantages thereof, may best be understood by reference to the following detailed description taken in conjunction with the accompanying drawings in which:

DETAILED DESCRIPTION OF A PREFERRED EMBODIMENT

Figure 1:
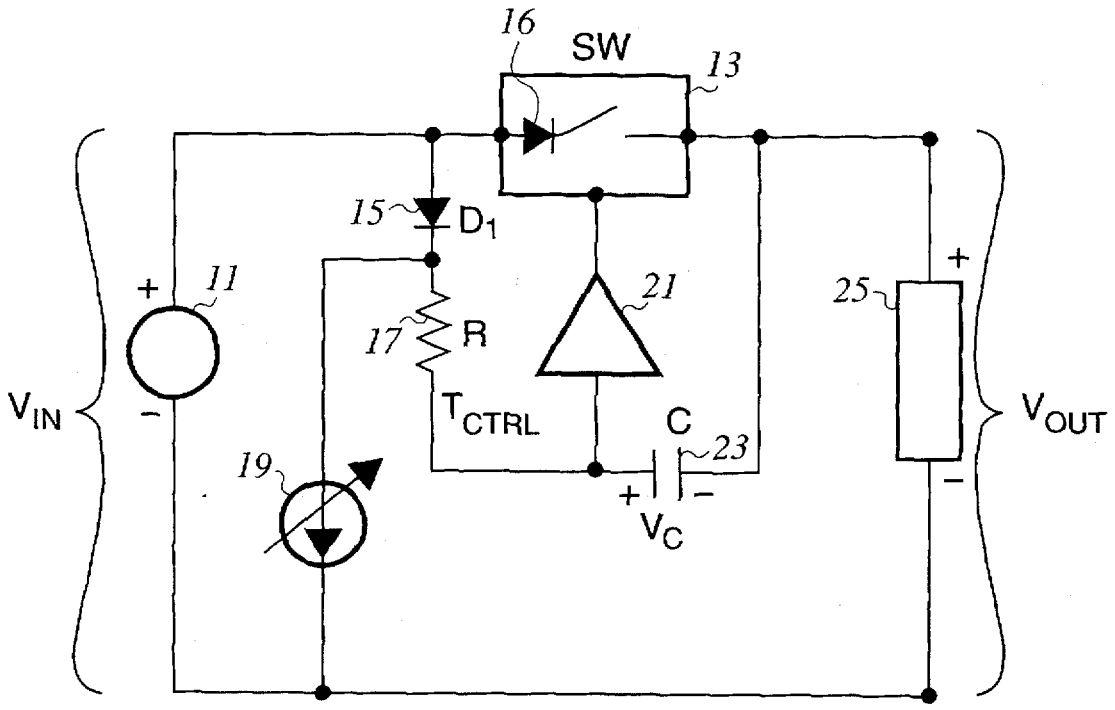
FIG. 1 is a schematic of a circuit that emulates a "normally-on" saturable reactor pursuant to one embodiment of the present invention.

Turning to FIG. 1, a circuit is depicted that emulates a "normally-on" saturable reactor. A voltage-controlled switch 13 connects voltage input $V_{IN}$ (i.e., from a voltage source 11) to voltage output $V_{OUT}$ (i.e., to load 25) through its current carrying terminals (diode 16 within switch 13 represents the switches unidirectionality). A control terminal of switch 13 is driven by a comparator 21 which has an output that switches when its input exceeds a threshold voltage $V_{TH}$. Comparator 21 may include some degree of hysteresis in its switching function such that it operates as a Schmitt Trigger.

The input of comparator 21 is a node within an integrating circuit connected across switch 13. This integrating circuit includes a diode 15, a resistor 17 and a capacitor 23 which together coupled the current carrying terminals of switch 13. The input of comparator 21 is connected to the node between resistor 17 and capacitor 23.

A control current is provided by variable current source 19 which is connected between the junction of diode 15 and resistor 17, and the junction of voltage source 11 and load 25.

Figure 2:
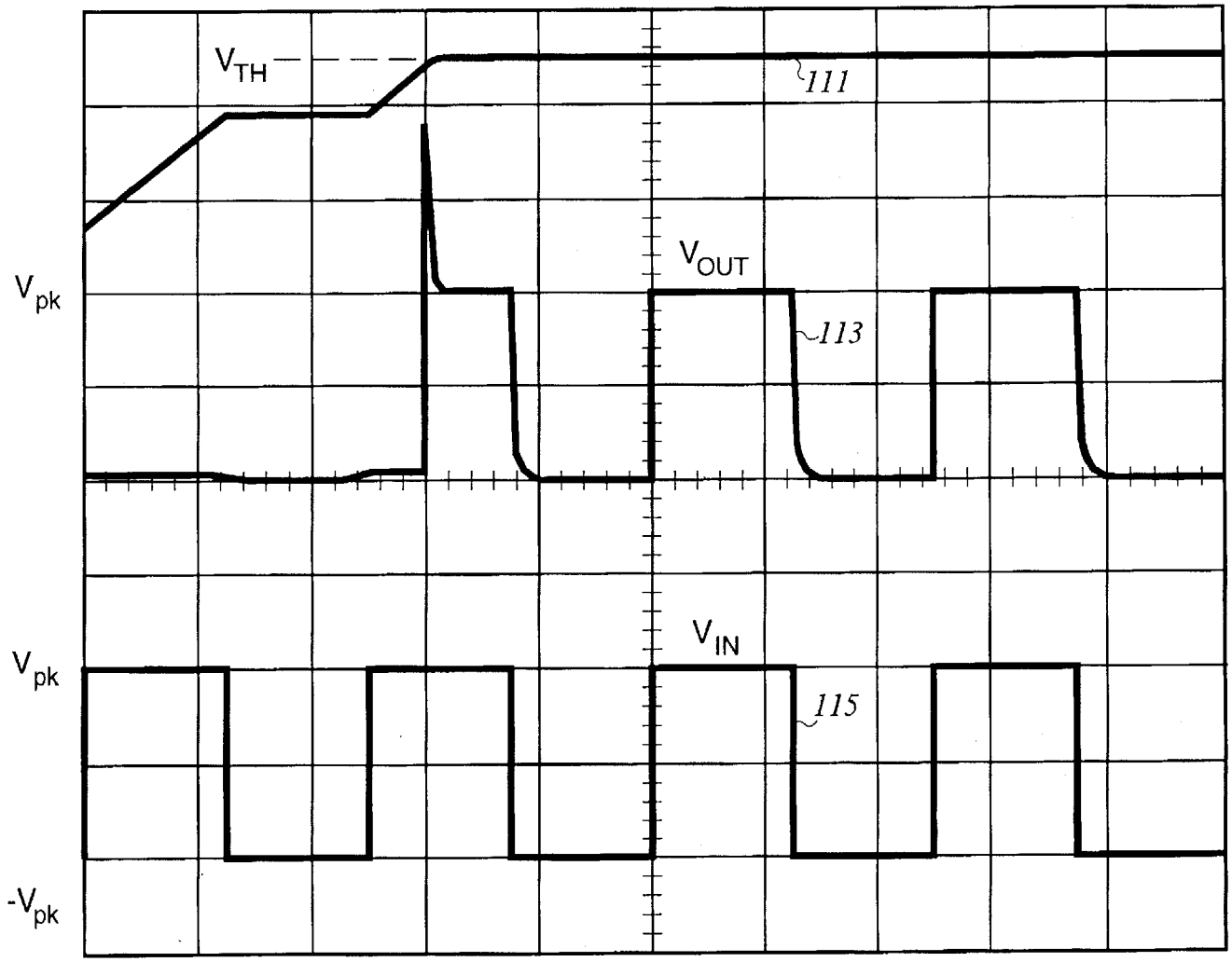
FIG. 2 depicts waveforms associated with the operation of the circuit of FIG. 1 when the control current has a zero value.

Operationally, the circuit of FIG. 1 is described below in connection with the waveforms shown in FIGS. 2–3. In a first case, assuming the control current (from current source 19) is zero and the input voltage is either AC or unipolar pulsed, example waveforms are depicted in FIG. 2. The series combination of diode 15, resistor 17 and capacitor 23 integrates the voltage across switch 13. The voltage across capacitor 23 rapidly charges (TRACE 111) to a voltage higher than $V_{TH}$, causing comparator 21 to turn switch 13 "on". Diode 15 prevents capacitor 23 from discharging, and thus the voltage across capacitor 23 will be maintained at $V_{TH}$. Absent leakage of capacitor 23, the output of comparator 21 will remain high and switch 13 will remain "on". As seen in FIG. 2, once turned "on", the emulator circuit passes the entire positive portion of $V_{IN}$ (TRACE 113) to $V_{OUT}$ (TRACE 115) through switch 13.

Figure 3:
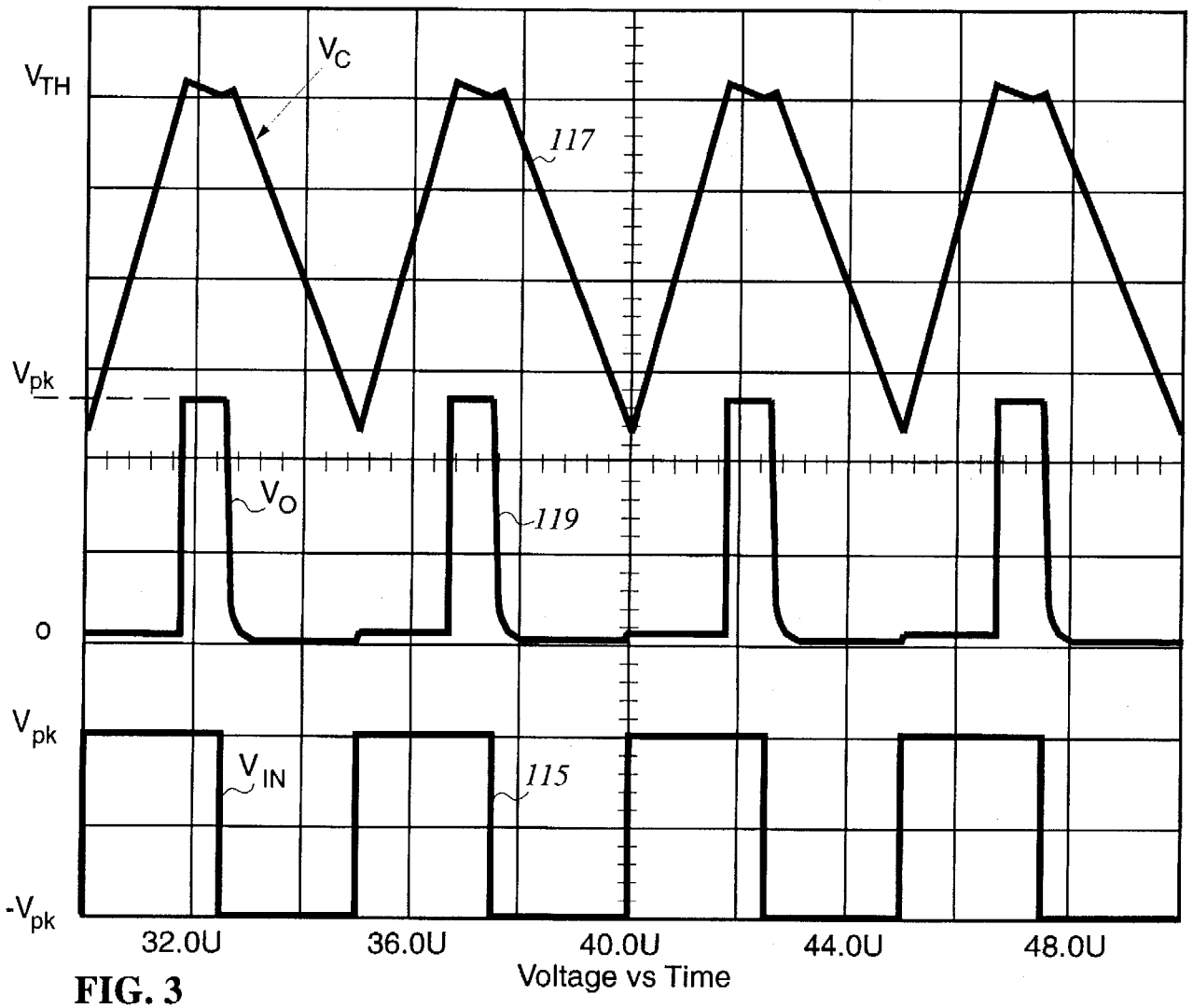
FIG. 3 depicts waveforms associated with the operation of the circuit of FIG. 1 when the control current is greater than zero.

Turning to FIG. 3, operational waveforms are depicted in a case where the control current from current source 19 is greater than zero. Charge is extracted from capacitor 23 by the control current (TRACE 117-capacitor voltage $V_c$). Thus, depending on the amount of control current, sometime after switch turn-on, the capacitor voltage will fall below $V_{TH}$ (offset by the hysteresis of comparator 21) and switch 13 will turn off. When the input voltage becomes positive again, switch 13 will remain off until capacitor 23 charges again to $V_{TH}$, at which point in time the switch will again turn on (TRACE 119).

The length of the delay until the turn-on and turn-off of switch 13 is determined by the degree of discharge of capacitor 23, which is in turn, determined by the amount of control current $I_{CTRL}$. Accordingly, by varying the magnitude of control current from current source 19, the duty cycle of the voltage appearing at $V_{OUT}$ 25 can be varied from a maximum value to zero.

Although an input waveform with a 50 percent duty cycle is shown in the figures presented herein, it will be apparent that the techniques of all embodiments of the present invention apply to any AC or unipolar pulsed waveform with a duty cycle between 0 and 100 percent.

Figure 4:
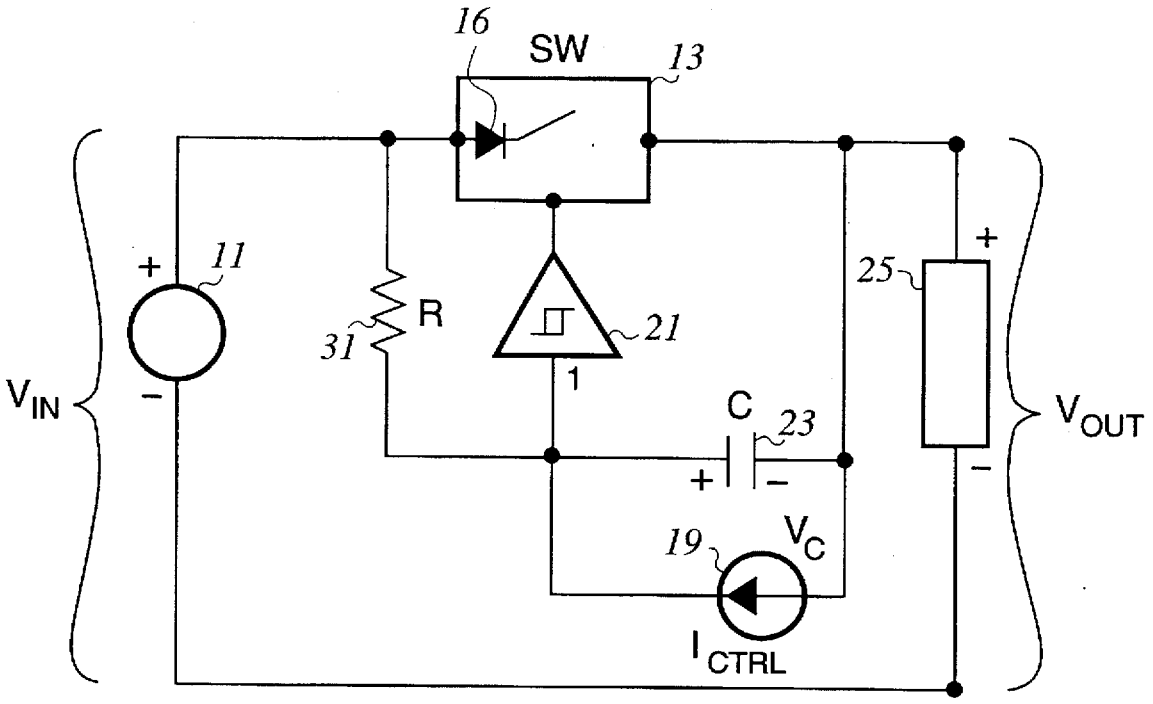
FIG. 4 depicts a schematic of a circuit that emulates a "normally-off" saturable reactor pursuant to an embodiment of the present invention.

The circuit of FIG. 4 emulates an ideal "normally-off" saturable reactor. That is, the transfer of voltage from input to output is blocked when the control current is zero. The circuit of FIGS. 4 is similar to that of FIG. 1, but has several differences that account for the "normally-off" (FIG. 4) versus "normally-on" (FIG. 1) operation.

In particular, the integrating circuit connected across switch 13 has been modified to exclude diode 15. Also, control current 19 has been moved to a configuration in parallel with capacitor 23. Operationally, the control current $I_{CTRL}$ charges capacitor 23 instead of discharging it (i.e., injects energy into the integrator circuit rather than extracting it).

Figure 5:
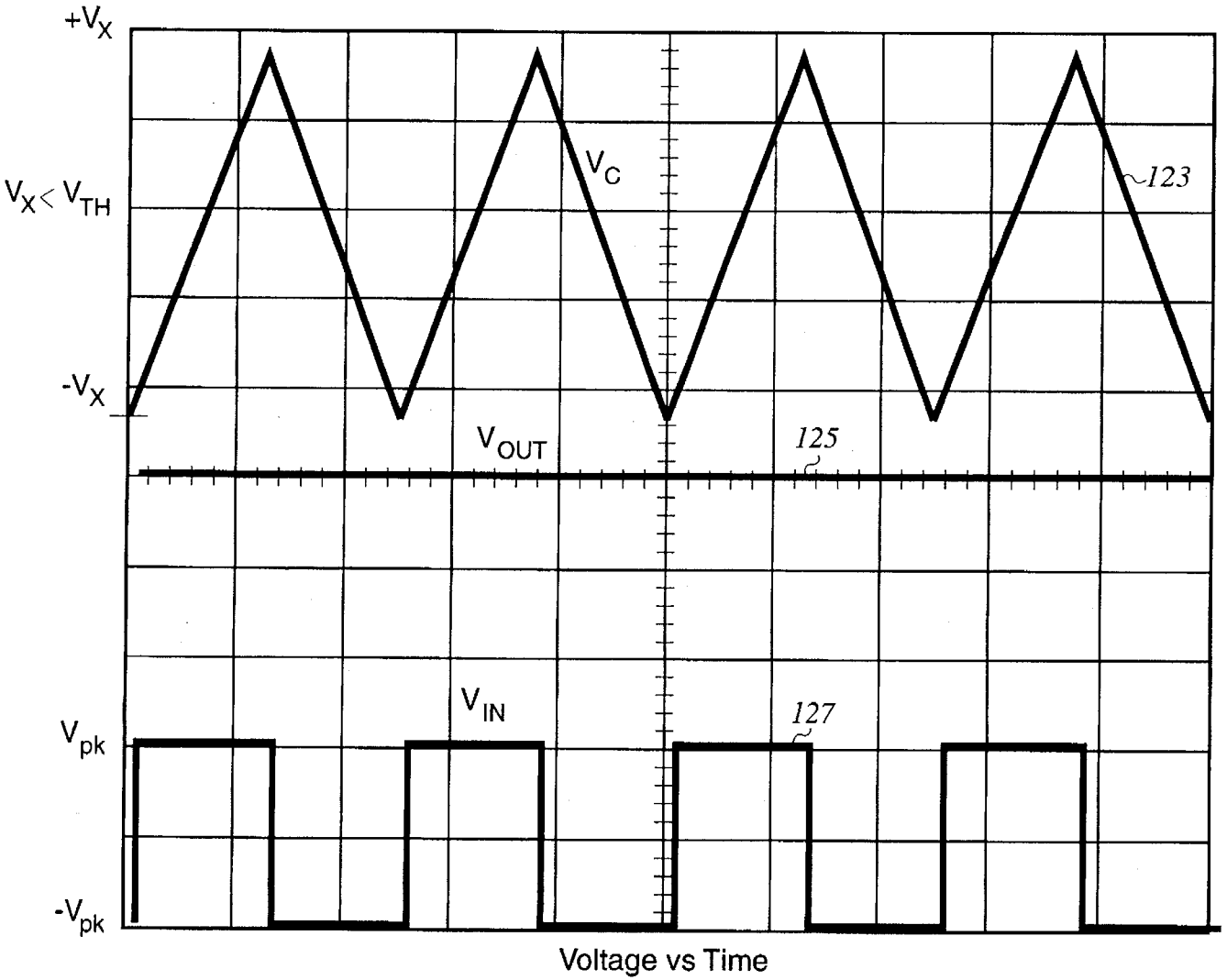
FIG. 5 depict waveforms associated with the operation of the circuit of FIG. 4 when the control current has a zero value.

Turning to FIG. 5, an operational example of the circuit of FIG. 4 is presented wherein the input voltage $V_{IN}$ is an AC waveform (TRACE 127) with a zero average value, and the control current is zero. Capacitor 23 will charge to a voltage $V_X$ and discharge to voltage $-V_X$ (see, for example, FIG. 5, TRACE 123). As long as $V_X$ is less than $V_{TH}$, switch 13 will not turn on (TRACE 125), thus achieving a normally-off configuration.

Figure 6:
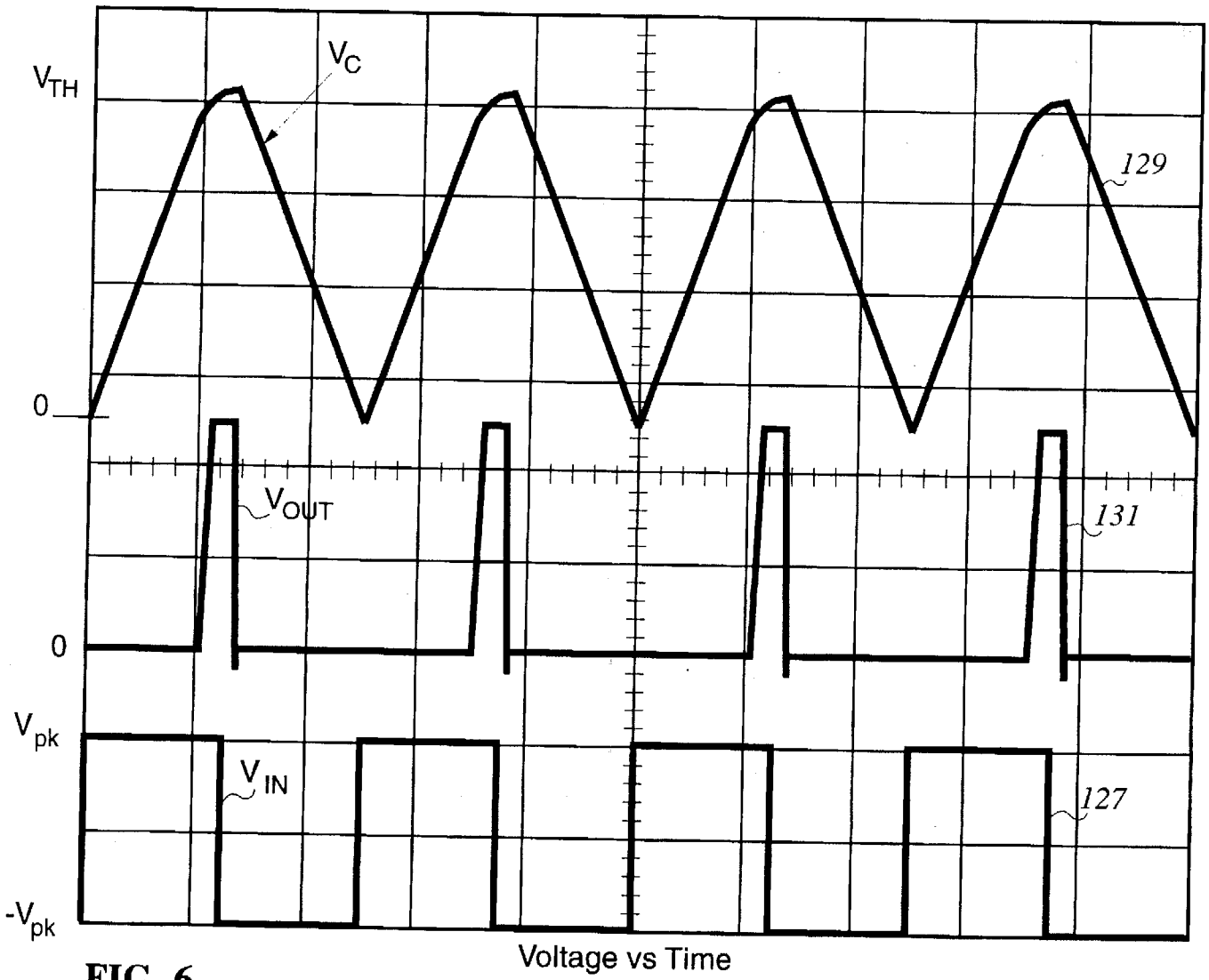
FIG. 6 depicts waveforms associated with the operation of the circuit of FIG. 4 when the control current is greater than zero.

The waveforms of FIG. 6 depict operational signals when a current $I_{CTRL}$ is injected into capacitor 23. A DC bias will develop across the capacitor, and at some point in time, the voltage on capacitor 23 will exceed $V_{TH}$ (TRACE 129). At this point, switch 13 will turn on and couple the input voltage $V_{IN}$ to the output $V_{OUT}$ (TRACE 131). As the control current $I_{CTRL}$ increases, switch 13 will conduct for longer periods of time until the conduction will extend for the entire duration of the positive part of the input voltage.

Several variations are possible regarding the circuits disclosed herein. For instance, the current source may include an inverse dependency on the input voltage (i.e., to the voltage source), thereby eliminating loop gain variations due to changes in the input voltage value. Alternatively, a constant current source could be used to charge the capacitor (in the normally-off configuration) during the positive section of the input voltage. When the circuits of the present invention are incorporated into a power supply circuit, voltage source 11 could be, for example, an inverter or chopper circuit for producing AC or unipolar pulsed signals, respectively.

While the invention has been described in detail herein, in accordance with certain preferred embodiments thereof, many modifications and changes thereto can be affected by those skilled in the art. Accordingly, it is intended by the impended claims to cover all such modifications and changes as fall within the true spirit and scope of the invention.

For instance, switch 13 can be implemented using several available technologies and shall not be limitive of the present invention. For example, switching elements including transistors, IGBT's, MOSFET's, and/or SCR's may be used. Further, if the selected switching element does not have reverse blocking capability, a diode may be added in series with the switching element (e.g., diode 16 in FIGS. 1,4) and shall be considered part of "switch" 13 as used and claimed herein. Even further, depending on required applications, circuit elements can be relocated, the polarity of connections can be reversed and the principle of duality can be applied to yield circuits consistent with the spirit and scope of the invention.

I claim:

1. A power converter circuit comprising:

an input;

an output;

a switch having a control input and current carrying terminals, wherein said current carrying terminals couple said input to said output;

an integrator connected across the current carrying terminals of the switch, wherein said integrator includes an integrator output; and a comparator coupling said integrator output of said integrator to the control input of said switch, wherein said comparator turns on said switch when said output of said integrator exceeds a threshold voltage.

2. The circuit of claim 1, further including a control current source coupled to said integrator.

3. The circuit of claim 2, wherein the integrator comprises a series connected diode, resistor and capacitor.

4. The circuit of claim 3, wherein the integrator output comprises a node joining the resistor and the capacitor.

5. The circuit of claim 4, wherein the control current source is connected to a node joining the diode and the resistor.

6. The circuit of claim 2, wherein the integrator comprises a series connected resistor and capacitor.

7. The circuit of claim 6, wherein the integrator output comprises a node joining the resistor and the capacitor.

8. The circuit of claim 7, wherein the control current source is connected across the capacitor.

9. The circuit of claim 1, wherein said switch is unidirectional.

10. The circuit of claim 1, wherein said switch includes a bidirectional switching element and said switch further comprises a diode in series with said switching element.

11. The circuit of claim 2, further comprising a voltage source connected to said input, wherein said control current source includes a dependency on said voltage source to stabilize said circuit with respect to variations in said voltage source.

12. The circuit of claim 1, further comprising a voltage source connected to said input.

13. The circuit of claim 12, wherein said voltage source comprises an inverter circuit.

14. The circuit of claim 12, wherein said voltage source comprises a chopper circuit.

15. The circuit of claim 12, further comprising a load connected to said output.

16. A power converter circuit comprising:

a voltage source;

an output;

a switch having a control input and current carrying terminals, wherein said current carrying terminals couple said voltage source to said output;

an integrator connected across the current carrying terminals of the switch, wherein said integrator includes an integrator output;

a current source coupled to said integrator; and a comparator coupling said integrator output of said integrator to the control input of said switch, wherein said comparator turns on said switch when said output of said integrator exceeds a threshold voltage.

17. The power supply circuit of claim 16, wherein said voltage source comprises a chopper circuit.

18. The power supply circuit of claim 16, wherein said voltage source comprises an inverter circuit.

19. A power converter circuit comprising:

a voltage source;

an output;

a switch having a control input and current carrying terminals, wherein said current carrying terminals couple said voltage source to said output;

an integrator connected across the current carrying terminals of the switch, wherein said integrator includes an integrator output;

a current source coupled to said integrator for controllably effecting an amount of energy stored therein; and a comparator coupling said integrator output of said integrator to the control input of said switch, wherein said comparator turns on said switch when said output of said integrator exceeds a threshold voltage.

20. The circuit of claim 19, wherein said current source injects energy into said integrator.

21. The circuit of claim 19, wherein said current source extracts energy from said integrator.

* * * * *